US005372191A

United States Patent [19]

Efimkin

[11] Patent Number: 5,372,191

[45] Date of Patent: Dec. 13, 1994

[54] DEVICE FOR REMOVING PARAFFIN AND OTHER DEPOSITS FROM THE INTERNAL SURFACE OF PIPES

[76] Inventor: Alexei A. Efimkin, ulitsa Pripolyarnaya, 10.kv.75, Respublika Komi, Usinsk, Russian Federation

[21] Appl. No.: 949,838

[22] PCT Filed: Oct. 22, 1991

[86] PCT No.: PCT/SU91/00209

§ 371 Date: Nov. 13, 1992

§ 102(e) Date: Nov. 13, 1992

[87] PCT Pub. No.: WO92/13171

PCT Pub. Date: Aug. 6, 1992

[30] Foreign Application Priority Data

Jan. 28, 1991 [SU] U.S.S.R. ..... 4907025

[51] Int. Cl.[5] ..... E21B 37/02

[52] U.S. Cl. ..... 166/170; 166/173

[58] Field of Search ..... 166/173, 304, 170, 174, 166/175; 138/178, DIG. 6

[56] References Cited

U.S. PATENT DOCUMENTS 2,220,237 11/1940 Hall .
3,044,552 7/1962 Claiborne ..... 166/170
3,251,306 5/1966 Plunk ..... 166/170
3,507,328 4/1970 Henderson .
3,537,519 11/1970 Long ..... 166/175
4,007,784 2/1977 Watson et al. ..... 166/170
4,572,291 2/1986 Robinson .

FOREIGN PATENT DOCUMENTS 153890 8/1963 U.S.S.R. .
1594265 9/1990 U.S.S.R. .

*Primary Examiner*—Terry Lee Melius
*Attorney, Agent, or Firm*—Lilling & Lilling

[57] ABSTRACT

A device comprises cleaning heads 4,5 mounted on a shaft for free rotation. On sinking and elevating the device on a tractive member, in a liquid up-current, the heads start rotating in different sides. Cutting elements—knives—having an involute profile and arranged on oppositely directed spiral paths cut the deposits. On descent, cutting collars of said knives situated in the lower portion on head perform "rough" cutting, the knives of both heads crush the cuts and chips, and cutting collars in the upper portion of the upper head carry out the "finishing" of the internal surface of an uptake pipe. The given mathematical relations defining the ratio of parameters of the device elements are as follows: the heights of heads and an angle of attack of knives, the lengths of the shaft and a stabilizer, their mass, the length of the pitch of knives and the diameter of the heads.

6 Claims, 2 Drawing Sheets

DEVICE FOR REMOVING PARAFFIN AND OTHER DEPOSITS FROM THE INTERNAL SURFACE OF PIPES

FIELD OF THE INVENTION

The claimed invention relates to devices of the type used for petroleum production, more specifically, those for removing paraffin and other deposits from the internal surface of pipes in oil wells.

DESCRIPTION OF THE PRIOR ART

The operation of oil wells is complicated by the intensive deposits of paraffin and other solid deposits on the inner walls of the pipes of an uptake column, which considerably encumbers and more often than not totally precludes the passage of oil therealong.

For purposes of cleaning the interior space of pipes use is made of various constructions of devices.

Known in the art is a device for removing paraffin from the interior spaces of oil collecting pipe lines with an air-tight gas/oil collecting system, which comprises upper and lower cleaning heads installed on the body portion, cutting members—knives provided on the external lateral surface of the cleaning heads, and an attachment to a tractive member that is situated in the upper part of the body (SU, A, 153890). The provision in the prior art device of a valve unit whose shut-off member is coupled with the tractive member, and a seal mounted on the body portion, complicate the prior art device and aggravate the reliability of its operation. The device can hang up at the sections of a non-uniform intensity of paraffin deposits and be jammed in the deformed sections of piping. The device is not intended for the removal of solid deposits.

Also known is a device of the type for removing paraffin from the internal surface of pipes, comprising a body portion in the form of a shaft, upper and lower cleaning heads carried by the shaft for rotation in opposite sides with respect to each other in a stream of fluid, cutting elements provided on oppositely directed spiral paths over the external surface of said cleaning heads, a main stabilizer disposed on the shaft between the upper and lower cleaning heads, and an attachment to a tractive member (SU, A, 1594265).

The prior art device is deficient in that the force of a stream of fluid is insufficient for overcoming the resistance created by cutting elements (pins) which are in cooperation with the pipe walls, whereby the cleaning heads are not rotated, a factor that lowers the efficiency and quality of the cleaning of the internal surface of pipes.

SUMMARY OF THE INVENTION

It is the principal object of the present invention to provide a device of the type used for cleaning the interior spaces of pipes from paraffin and other deposits in such a way as to improve the efficiency and quality of cleaning steps under low temperatures and in the presence of a gas-oil ratio by selecting the most favourable structural dimensions of device elements with the simultaneous simplification of the construction.

Said task is to be solved with a device for removing paraffin and other deposits from the interior space of pipes. A body portion is constructed as a shaft, and upper and lower cleaning heads are disposed on the shaft for rotation to opposite sides relative to each other in a stream of fluid. Cutting elements are provided on oppositely directed spiral paths on the external surface of said cleaning heads. A main stabilizer is carried by the shaft between the upper and lower cleaning heads. An attachment to a tractive member is equipped with a lock pin securely fastened in the lower part of the shaft. An auxiliary guide stabilizer fixed in the upper part of the shaft. The unit of attachment to the tractive member is positioned in the upper part of the auxiliary guide stabilizer. The cutting elements are shaped like knives with an involute profile. The upper and lower cleaning heads are supported on the shaft in bearings to form a section, and, along with this, in the upper portion of the upper cleaning head and in the lower portion of the lower cleaning head, the knives with the involute profile have cutting collars and the height of each cleaning head is derived from the relation: $H=D/2\ tg\alpha$, wherein H is the height of the cleaning head; and D is the diameter of the cleaning head; $\alpha$ is the angle of inclination of a cutting element (spiral) to the longitudinally extending axis of the cleaning head (the angle of attack of the knife).

The ratio of the length N of the shaft to a length L of the auxiliary guide stabilizer, the ratio of their masses Pn/Pl and the ratio of a length T of the pitch of the knives with the involute profile to the length of a circle $\pi D$ of a cleaning head are described by the relation: $N/L=Pn/Pl=T/\pi D=1/6$, wherein N is the length of the shaft; L is the length of the auxiliary guide stabilizer; Pn is the mass of the shaft; Pl is the mass of the auxiliary guide stabilizer; T is the length of the pitch of the knives with an involute profile; $\pi$ is const=3.14; and D is the diameter of the cleaning head.

A solution to the task set is also favoured by the fact that the upper and lower cleaning heads are supported on the shaft in sliding bearings fashioned as bushings with annular projections in the lower portions to cooperate with mating annular grooves provided in the lower portions of the cleaning heads. The bushing of the upper cleaning head is mounted on the upper part of the main stabilizer, the bushing of the lower cleaning head is mounted on the upper portion of a deepening lock pin, and between the upper portions of bushings and respectively the lower portions of the auxiliary guide stabilizer and the main stabilizer there are mounted radial antifriction bearings. The main and auxiliary guide stabilizers and the deepening lock pin have a maximal dimension in cross section smaller than that of the cleaning heads and the deepening lock pin is fixed in the lower part of the shaft by a fixed joint with a faculty of assembly-disassembly. In the case of a multisectional alternative embodiment of the device, the number of cleaning heads (even) exceeds the number of main stabilizers per unit.

SUMMARY OF THE DRAWINGS

The claimed invention is further explained by concrete examples illustrating its realization and by the drawings attached:

PREFERRED EMBODIMENT OF THE INVENTION

Figure 5:
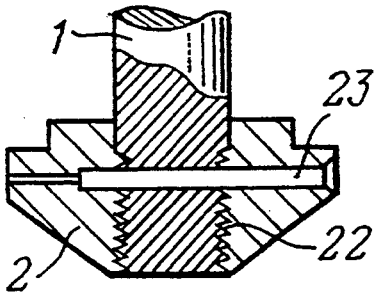
FIG. 5 shows a longitudinal sectional view of an alternative embodiment of a fixed joint of a deepening lock pin with a shaft of the invention.
Figure 1:
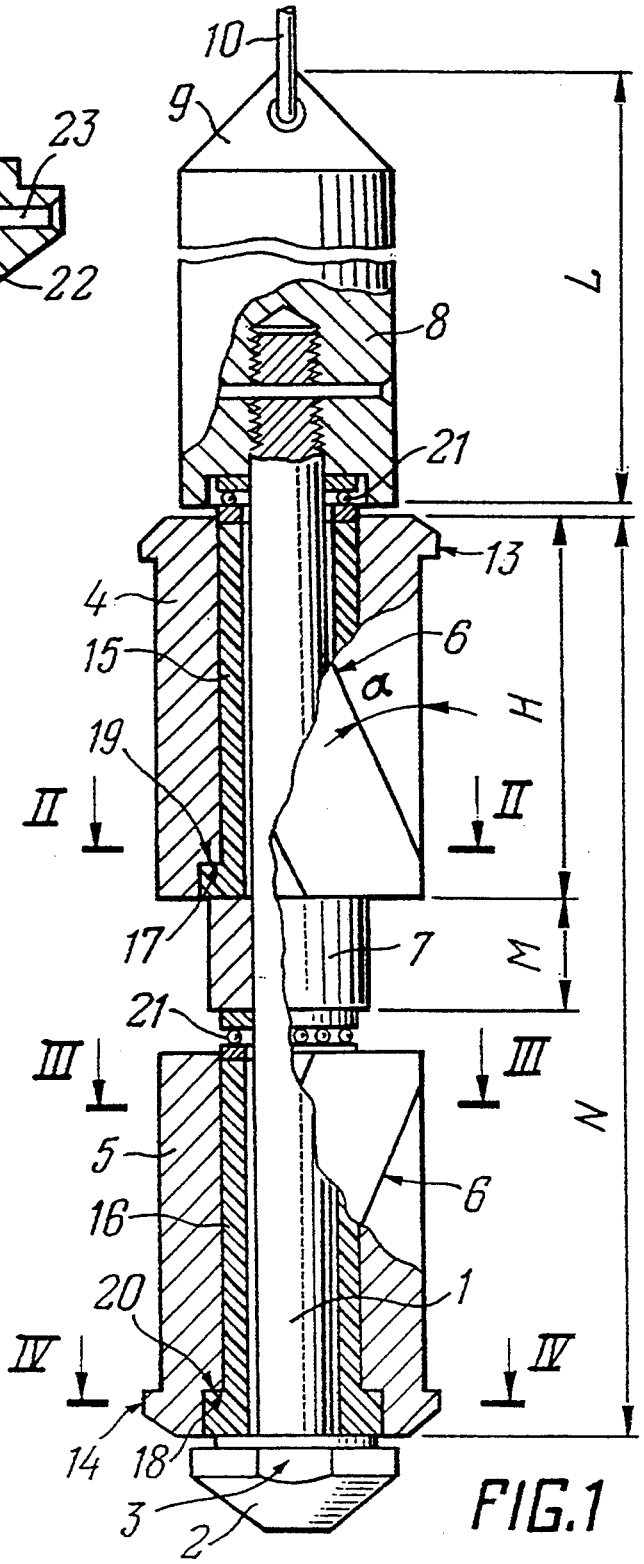
FIG. 1 shows a longitudinal sectional view of the construction of a device for removing paraffin and other deposits from interior spaces of pipes of the present invention.
Figure 2:
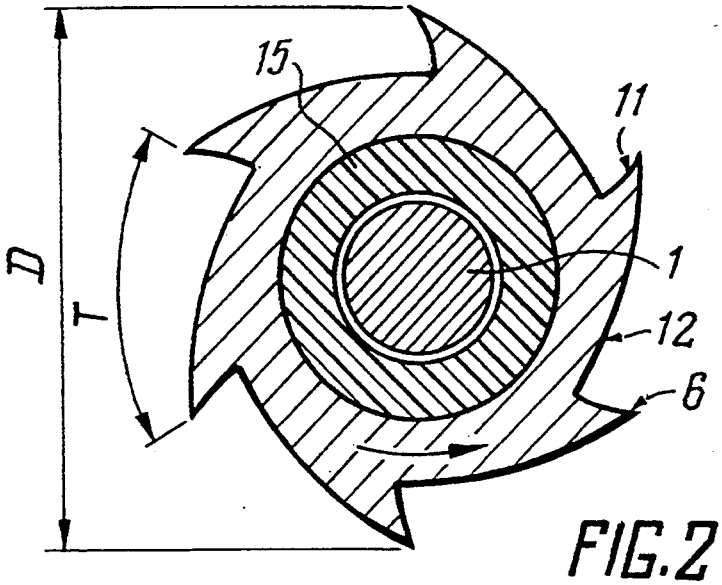
FIG. 2 shows a section along line II—II, FIG. 1.
Figure 3:
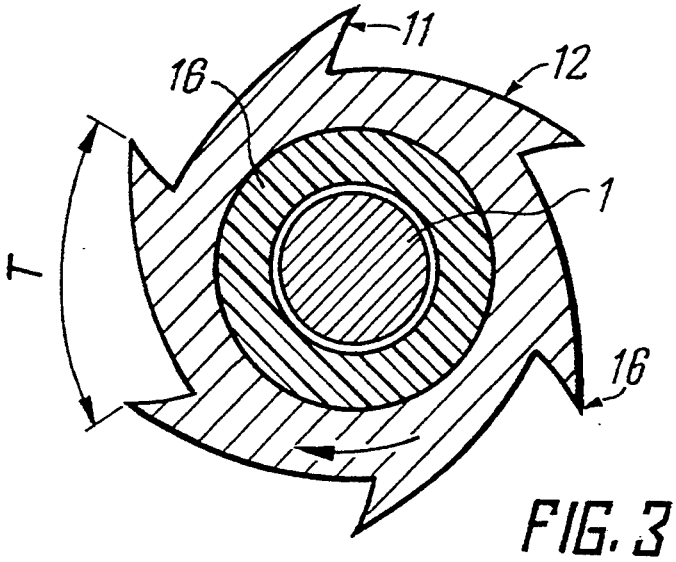
FIG. 3 shows a section along line III—III, FIG. 1.
Figure 4:
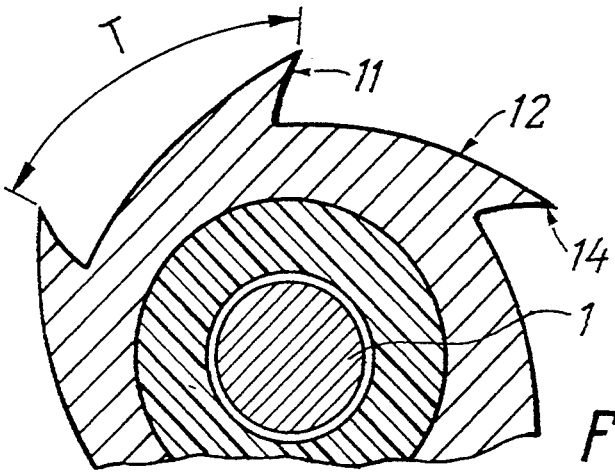
FIG. 4 shows a section along line IV—IV, FIG. 1.

A device of the type used for removing paraffin and other deposits from the interior spaces of pipes in accordance with the invention comprises a body portion in the form of a shaft 1 with a deepening lock pin 2 securely fastened in the lower part thereof, which has flats 3 for a tongs, and mounted on the shaft 1 by means of the fixed joint.

The fixed joint of the deepening lock pin 2 with the shaft 1 precludes a possibility of it being disconnected spontaneously, but enables one to perform its assembly-disassembly, if need be. On the shaft 1 there are rotatably mounted upper and lower cleaning heads 4,5, on whose exterior surfaces provision is made of cutting elements 6 arranged on oppositely directed spiral paths. Between said upper and lower cleaning heads 4,5 forming a working section, on the shaft 1 there is disposed a main stabilizer 7. Given a multisectional variation of the device, the total number of cleaning heads 4,5 is even and exceeds the number of main stabilizers 7 per unit. In the upper part of the shaft 1 is mounted an auxiliary guide stabilizer 8. In the upper part of said stabilizer 8, a unit 9 of attachment to a tractive member is situated 10 (say, wire tied with a winch). Cutting elements 6 are made as knives with an involute profile 11, 12. In the upper portion of upper cleaning head 4 and in the lower portion of lower cleaning head 5, the knives with involute profiles 11,12 have cutting collars 13,14. The height of each cleaning head is defined in the relation; $H=D/2tg\alpha$, wherein H is the height of a cleaning head; D is the diameter of a cleaning head; and $\alpha$ is the angle of inclination of a cutting element (spiral coils) to a longitudinal axis of a cleaning head (an angle of attack of the knife).

The upper and lower cleaning heads 4,5 are mounted on the shaft 1 in sliding bearings constructed as bushings 15,16 with annular projections 17,18 in the lower parts thereof for cooperation with mating annular grooves 19, 20 provided in the lower portions of cleaning heads 4,5. Bushing 15 of the upper cleaning head 4 is mounted on the upper part of the main stabilizer 7. Accordingly, the bushing 16 of the lower cleaning head 5 is mounted on the upper portion of the deepening lock pin 2. Between the upper portions of bushings 15, 16 and respectively the lower parts of the auxiliary guide stabilizer 8 and main guide stabilizer 7, provision is made of radial antifriction bearings 21. Shaft 1, auxiliary guide stabilizer 8 and cleaning heads 4,5 are made such that the ratio of a length N of the shaft to a length L of the auxiliary guide stabilizer 8, the ratio of their masses Pn/Pl and the ratio of a length T of the pitch of knives with involute profiles 11, 12 to the length of a circle $\pi D$ of cleaning heads 4, 5 are described in the relation: $N/L=Pn/Pl=T/\pi D=1/6$, wherein N is a shaft length, L is the length of an auxiliary guide stabilizer; Pn is a shaft mass; Pl is a mass of an auxiliary guide stabilizer; T is a pitch length of knives with an involute profile; $\pi$ is const=4.13; and D is the diameter of a cleaning head.

The main and auxiliary guide stabilizers 7, 8 and deepening lock pin 2 have a maximal dimension in cross section less than that of the cleaning heads 4,5.

The fixed joint of deepening lock pin 2 on the shaft 1 may, for instance, be made by means of a thread 22 and fixed by a pin 23.

The bushings 15,16 may be constructed from an antifriction material such as fluoro-plastic.

The distance between cutting collars 13, 14 of said cleaning heads 4, 5 in actual fact corresponds to the length N of shaft 1 and equals: $N=2H+M$, wherein N is a shaft length corresponding to the distance between the cutting collars of the cleaning heads; H is the height of a cleaning head; and M is the height of the main stabilizer.

The mathematical relation of parameters of the elements of the claimed device have been determined experimentally and confirmed by the operation of the device concerned at oil fields.

The operation of a device for removing paraffin and other deposits from the interior spaces of pipes is illustrated by an example of its single-sectional embodiment.

The device is operated as follows.

When a buffer gate valve is closed, the device is placed in a lubricator (oil cup)/not shown/ to be later hermetically sealed. The buffer gate valve is opened and the tractive member 10 is used for descending the device into a column of uptake pipes (not shown) till contact with a fluid being admitted under pressure from a bottom hole in the form of stream. Owing to the fact that the cutting elements—knives 6—are arranged on the cleaning heads 4, 5 on oppositely directed spiral paths, said cleaning heads start rotation in the stream of fluid of the opposite sides relative to each other. Cutting collars 14 of the lower cleaning head 5 perform the "rought" cutting of deposits on the walls of a column of the uptake pipes, and the knives 6 of the lower and upper cleaning heads 4 crush the cuts (chip) of deposits, while the cutting collars 13 of the upper cleaning head 4 perform the "finishing" of the interiors of said column of uptake pipes. The stream of fluid transports the crushed material of deposits to the mouth and what is more, the crushed paraffin (asphaltic-resinous components) does not tend any more to deposit on the polished internal surface of the column of uptake pipes.

The device is sunk to a predetermined depth, whereupon it is lifted by the tractive member 10, in which case the "rough" deposit cutting is implemented by the cutting collars 13 of the upper cleaning head 4. The rest is done as described hereinabove.

INDUSTRIAL APPLICABILITY

The claimed construction of a device enables one to reliably operate it given a gas-oil ratio in a liquid extracted, assures the qualitative and effective purification of interior spaces in an automatic mode of operation, and permits movement "downward-upward-downward" etc, without rising to the day surface for a long period of time. For instance, with the 28% contained asphalt-resinous-paraffin deposit components, the time period between repairs is 150–180 days against 18–25 days as before, which is especially important in low temperature conditions. The use of the device does not interrupt the operation of a well, a factor that permits increasing the production by 2–4 tons per day and also giving up the application of methods of electrochemical treatment, aggregates for feeding and preheating a detergent. The device features ease of construction, small expenses on manufacture as well as the improved efficiency and convenience in operation and service. With the use of the device under examination in 122 holes alone at one oil field brings about 1,7 mln rubles in profit.

We claim:

1. A device of the type used for removing paraffin and other deposits from the interior space of pipes, comprising a body portion in the form of a shaft, upper and lower cleaning heads rotatably mounted on the shaft 1 in opposite sides relative to each other in a stream of fluid, cutting elements arranged on oppositely directed spiral paths on the external surfaces of said cleaning heads, a main stabilizer disposed on the shaft between said upper and lower cleaning heads and a unit of attachment to a tractive member characterized in that it is provided with a deepening lock pin securely fastened in the lower part of the shaft and with an additional guide stabilizer mounted in the upper part of shaft, the unit of attachment to the tractive member is situated in the upper part of additional guide stabilizer, the cutting elements are fashioned as knives with an involute profile, the upper and lower cleaning heads are supported on the shaft in bearings to form a section, and along with this, in the upper portion of the upper cleaning head and in the lower portion of the lower head said knives, having said involute profile, have cutting collars, and the height of each cleaning head is determined in the relation: $H=D/2tg\alpha$ wherein H is the height of a cleaning head; D is the diameter of a cleaning head; $\alpha$ is an angle of inclination of a cutting element (spiral coils) to the longitudinally extending axis of a cleaning head (an angle of attack of the knife).

2. A device for removing paraffin and other deposits from the interior space of pipes according to claim 1, characterized in that the ratio of a length N of the shaft to a length L of the additional guide stabilizer, the ratio of their masses Pn/P1 and the ratio of a length T of the pitch of knives with the involute profile to the length of a circle $\pi D$ of the cleaning head are described by the relation: $N/L=Pn/P1=T/\pi D=1/6$, wherein N is the shaft; L is the length of the additional guide stabilizer; Pn is the shaft mass; P1 is a mass of the additional guide stabilizer; T is the length of the pitch of knives with the involute profile; $\pi$ is a const=3.14; and D is the diameter of the cleaning head.

3. A device for removing paraffin and other deposits from the interior space of pipes according to claim 1, characterized in that the upper and lower cleaning heads are support on the shaft in sliding bearings in the form of bushings with annular projections in the lower parts thereof for cooperation with mating annular grooves provided in the lower portions of cleaning heads, said bushing of said upper cleaning head being mounted on the upper part of the main stabilizer, the bushing of the lower cleaning head being mounted on the upper portion of the deepening lock pin, and between the upper portions of the bushings and respectively the lower parts of the additional guide stabilizer and the main guide stabilizer are mounted radial antifriction bearings.

4. A device for removing paraffin and other deposits from the interior space of pipes according to claim 1, characterized in that the main and additional guide stabilizers and the deepening lock pin have a maximal dimension in cross section smaller than that of the cleaning heads.

5. A device for removing paraffin and other deposits from the interior space of pipes according to claim 1, characterized in that the deepening lock pin is mounted in the lower part of the shaft by a fixed joint with a faculty of assembly-disassembly.

6. A device for removing paraffin and other deposits from the interior space of pipes according to claim 1, characterized in that in the case of a multisectional embodiment thereof the total number of cleaning heads is even and exceeds the number of main stabilizers per unit.

* * * * *